US012196220B2

(12) United States Patent
Ku et al.

(10) Patent No.: US 12,196,220 B2
(45) Date of Patent: Jan. 14, 2025

(54) BLOWER HAVING FIRST AND SECOND TOWERS AND A HANDLE ARRANGEMENT

(71) Applicant: LG ELECTRONICS INC., Seoul (KR)

(72) Inventors: Myungjin Ku, Seoul (KR); Juhyup Yoon, Seoul (KR); Kunyoung Lee, Seoul (KR); Bohyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 191 days.

(21) Appl. No.: 17/940,151

(22) Filed: Sep. 8, 2022

(65) Prior Publication Data

US 2023/0081328 A1 Mar. 16, 2023

(30) Foreign Application Priority Data

Sep. 15, 2021 (KR) ..... 10-2021-0123234

(51) Int. Cl.
*F04D 29/40* (2006.01)
*F04D 29/44* (2006.01)
(Continued)

(52) U.S. Cl.
CPC ..... *F04D 29/403* (2013.01); *F04D 29/441* (2013.01); *F24F 1/01* (2013.01);
(Continued)

(58) Field of Classification Search
CPC .... F04F 5/16; F04F 5/44; F04D 25/08; F04D 25/084; F04D 29/403; F04D 29/44; F24F 1/01; F24F 13/20; F24F 13/26
See application file for complete search history.

(56) References Cited

U.S. PATENT DOCUMENTS 9,157,458 B2 10/2015 Kubo
2013/0234347 A1 9/2013 Staniforth
(Continued)

FOREIGN PATENT DOCUMENTS

CN 202883401 4/2013
CN 106930986 7/2017
(Continued)

OTHER PUBLICATIONS

Japanese Office Action dated Sep. 12, 2023 issued in Application No. 2022-145967.
(Continued)

*Primary Examiner* — Nathan C Zollinger
(74) *Attorney, Agent, or Firm* — KED & ASSOCIATES, LLP

(57) ABSTRACT

The present disclosure relates to a blower. The blower according to an aspect of the present disclosure includes: a lower case in which a suction port is formed; a fan disposed inside the lower case and blowing air introduced through the suction port upward; a first tower elongated to an upper side from the lower case and formed with a first discharge port opening forward; a second tower spaced apart from the first tower in a horizontal direction, elongated to an upper side from the lower case, and formed with a second discharge port opening forward; an air guide disposed inside the first tower and spaced apart from a front end of the first tower and elongated along a front and rear direction toward the first discharge port; and a handle disposed between the fan and the air guide and elongated from upstream of the air guide toward the front end of the first tower. The handle is disposed between the fan and the air guide, so that the blowing performance of the blower can be enhanced.

18 Claims, 9 Drawing Sheets

(51) Int. Cl.

| | |
|---|---|
| ***F24F 1/01*** | (2011.01) |
| ***F24F 13/26*** | (2006.01) |
| *F04D 25/08* | (2006.01) |
| *F04F 5/16* | (2006.01) |

(52) U.S. Cl.
CPC ..... *F24F 13/26* (2013.01); *F04D 25/084* (2013.01); *F04D 29/44* (2013.01); *F04F 5/16* (2013.01)

(56) References Cited

U.S. PATENT DOCUMENTS

| | | | | |
|---|---|---|---|---|
| 2017/0164710 | A1 | 6/2017 | Warne | |
| 2019/0170162 | A1* | 6/2019 | Jennings | F04D 19/002 |
| 2021/0277911 | A1 | 9/2021 | Jung et al. | |

FOREIGN PATENT DOCUMENTS

| | | | | | |
|---|---|---|---|---|---|
| CN | 208587996 | | | 3/2019 | |
| GB | 2478927 | A | * | 9/2011 | F04D 25/08 |
| GB | 2493505 | A | * | 2/2013 | F04D 25/08 |
| JP | S50-155457 | | | 12/1975 | |
| JP | 2013015114 | A | * | 1/2013 | F04D 25/10 |
| JP | 2013-142332 | | | 7/2013 | |
| JP | 2015117643 | A | * | 6/2015 | |
| JP | 2017067064 | A | * | 4/2017 | |
| JP | 2017115630 | A | * | 6/2017 | |
| JP | 6650562 | B2 | * | 2/2020 | F04D 25/08 |
| KR | 10-2019-0124680 | | | 11/2019 | |
| KR | 10-2021-0112122 | | | 9/2021 | |
| KR | 10-2021-0112123 | | | 9/2021 | |
| WO | WO 2013/105352 | | | 7/2013 | |
| WO | WO 2016/078346 | | | 5/2016 | |
| WO | WO 2017/110058 | | | 6/2017 | |
| WO | WO 2018/196437 | | | 11/2018 | |
| WO | WO 2021/107696 | | | 6/2021 | |
| WO | WO 2021/177713 | | | 9/2021 | |

OTHER PUBLICATIONS

Korean Office Action dated Mar. 16, 2023 issued in Application No. 10-2021-0123234.

Korean Office Action dated Mar. 16, 2023 issued in Application No. 10-2022-0124453.

European Search Report dated Jan. 25, 2023 issued in Application No. 22194861.5.

Korean Notice of Allowance dated Jul. 1, 2023 issued in Application No. 10-2022-0124453.

U.S. Notice of Allowance dated Sep. 17, 2024 issued in U.S. Appl. No. 18/385,488.

U.S. Office Action dated May 22, 2024 issued in U.S. Appl. No. 18/385,488.

* cited by examiner

BLOWER HAVING FIRST AND SECOND TOWERS AND A HANDLE ARRANGEMENT

CROSS-REFERENCE TO RELATED PATENT APPLICATIONS

This application claims priority to Korean Patent Application No. 10-2021-0123234, filed Sep. 15, 2021, whose entire disclosures are hereby incorporated by reference.

BACKGROUND OF THE DISCLOSURE

Field of the Disclosure

The present disclosure relates to a blower, and more particularly to a blower having a handle.

Related Art

A blower may cause a flow of air to circulate air in an indoor space or form airflow toward a user. When the blower is provided with a filter, the blower may supply air purified by the filter to an indoor space.

The blower includes a case defining an exterior and a fan disposed within the case. When changing a position where the blower is disposed in an indoor space, a user may grip the case and transport the case to a desired position.

However, the conventional blower is not often provided with a separate handle for gripping a case. In addition, even when the handle is provided, the handle is disposed at a position that interferes with the flow direction of the air blown from a fan, thereby reducing the blowing performance of the blower.

SUMMARY OF THE DISCLOSURE

An aspect of the present disclosure is to solve the above and other issues.

Another aspect of the present disclosure may be to facilitate transport of a blower.

Another aspect of the present disclosure may be to provide a blower having a handle for gripping a case.

Another aspect of the present disclosure may be to optimize a disposition position of the handle.

Another aspect of the present disclosure may be to provide a blower having a handle for guiding a flow direction of air blown from a fan.

Another aspect of the present disclosure may be to provide a blower with improved blowing performance.

Another aspect of the present disclosure may be to provide a blower in which flow loss of air blown from a fan is minimized.

The aspects of the present disclosure are not limited to those mentioned above, and other aspects not mentioned herein will be clearly understood by those skilled in the art from the following description.

A blower according to an aspect of the present disclosure includes: a lower case in which a suction port is formed; and a fan disposed inside the lower case and blowing air introduced through the suction port upward.

The blower includes: a first tower elongated to an upper side from the lower case and formed with a first discharge port opening forward; and a second tower spaced apart from the first tower in a horizontal direction, elongated to an upper side from the lower case, and formed with a second discharge port opening forward.

The blower includes an air guide disposed inside the first tower and spaced apart from a front end of the first tower and elongated along a front and rear direction toward the first discharge port, so that air blown from the fan may be guided to the first discharge port by the air guide.

The blower includes a handle disposed between the fan and the air guide and elongated from upstream of the air guide toward the front end of the first tower, so that the blower may be easily transported, and simultaneously, air blown from the fan may be guided to the front end of the first tower.

A plurality of the suction ports may be formed to be spaced apart from each other along a circumference of the lower case.

The handle may be positioned at an upper side of the suction port.

The handle may penetrate through the lower case and protrude toward an inner space of the lower case.

The lower case may include a groove connecting a lower portion of the first tower and a lower portion of the second tower.

The groove may be formed in a concave shape downwardly from an upper side of the fan.

The handle may be disposed between the fan and the groove.

The handle may include a guide wall facing the fan in an up-down direction.

The guide wall may be elongated to be inclined upward toward the front end of the first tower.

The handle may include a first wall spaced apart from an upper side of the guide wall and elongated toward an outer side of the lower case.

The handle may include a second wall connecting the first wall and the guide wall and elongated from the guide wall to an upper side thereof.

The blower may include a fan motor connected to the fan; and a fan motor housing that surrounds the fan motor and is spaced apart from an inner circumferential surface of the lower case.

A channel through which air blown from the fan flows may be formed between the fan motor housing and the lower case.

The handle may be disposed in an upper side of the channel.

A width in which the handle protrudes inwardly of the lower case may be smaller than a horizontal width of the channel.

The fan housing may include: a first housing wall elongated in an up-down direction; and a second housing wall connected to the first housing wall in an upper side of the fan and elongated to be inclined toward the handle.

The blower may include a diffuser disposed in an upper side of the fan and elongated to an upper side toward an inner space of the first tower.

The handle may be disposed in an upper side of the diffuser.

The first tower may include a protrusion protruding toward the first discharge port from the front end of the first tower.

The protrusion may be positioned between the air guide and the handle.

The protrusion may be positioned at an upper side of the groove.

The protrusion may be positioned at an upper side of an extension line of the guide wall.

The first discharge port may be elongated long along an up-down direction.

A plurality of the air guides may be disposed to be spaced apart from each other along a direction in which the first discharge port is elongated.

The air guide may be elongated from a rear end of the first tower toward the front end of the first tower.

One end of the air guide may be positioned forward than the first discharge port.

The air guide may be elongated to be inclined to a lower side toward the front.

An angle at which each of the plurality of air guides is inclined to a lower side may be greater as disposed closer to the lower side.

The handle may include a gripping portion protruding from an upper wall of the handle toward a lower side.

The handle may include a mounting portion protruding from the guide wall toward a lower side.

The mounting portion may be connected to the lower case.

The handle may include a boss having a fastening hole elongated in an up-down direction formed therein.

The boss may protrude toward the groove.

A front end of the first tower may be inclined rearward toward an upper side.

The details of other embodiments are included in the detailed description and drawings.

A blower 1 may include: a lower case 120 formed with a suction port 121; a fan 320 disposed inside the lower case 120; a fan motor 310 disposed in an upper side of the fan 320; a first tower 220 disposed in an upper side of the lower case 120, elongated long upward, and formed with a first discharge port 222; and a second tower 230 disposed in an upper side of the lower case 120, spaced apart from the first tower 220, elongated long upward, and formed with a second discharge port 232.

The blower 1 may include a motor housing 330 that is spaced apart from an inner side of the lower case 120 and surrounds the fan motor 310, and a diffuser 600 connecting a circumference of the motor housing 330 and the lower case 120.

The blower 1 may include a supporter 620 connecting a lower portion of surfaces 221*e* and 231*e* in which the first tower 220 and the second tower 230 face each other among the outer surfaces of the first tower 220 and the second tower 230 and the motor housing 330.

The blower 1 may further include a bridge 161 connecting lower portions of the surfaces 221*e* and 231*e* in which the first tower 220 and the second tower 230 face each other among the outer surfaces of the first tower 220 and the second tower 230.

In the blower 1, the supporter 620 may connect the bridge 161 and the motor housing 330.

In the blower 1, the supporter 620 may include an elongation 624 elongated laterally from a lower portion of the supporter 620.

In the blower 1, the elongation 624 may be connected to an upper portion of the motor housing 330.

In the blower 1, the cross-sectional area of the elongation 624 may correspond to the cross-sectional area of the upper portion of the motor housing 330.

In the blower 1, the supporter 620 may have a narrower cross-sectional area toward an upper side.

The blower 1 may further include a handle 170 disposed in a portion having a height corresponding to the supporter 620 in the lower case 120, wherein one surface protrudes inward and the other surface is opened to an outer side to form a gripping space 174.

In the blower 1, the supporter 620 may include a first surface 626*a* facing the handle 170, and a second surface 626*b* disposed in an opposite side of the first surface 626*a*.

In the blower 1, the first surface 626*a* may be inclined at a predetermined first angle s1 toward the second surface 626*b*.

In the blower 1, the second surface 626*b* of the supporter 620 may be inclined at a predetermined second angle s2 toward the first surface 626*a*, and the first angle s1 may be greater than the second angle s2.

The blower 1 may further include a blowing space S opened back and forth between the first tower 220 and the second tower 230.

In the blower 1, the first tower 220, the second tower 230, and the blowing space S may form a continuous surface with the lower case 120.

In the blower 1, the continuous surface may be a truncated cone whose cross-sectional area becomes narrower toward an upper side.

In the blower 1, the first tower 220 may include a first inner wall 221*e* facing the second tower 230 and forming an inner surface of the first tower 220, and a first outer wall 221*d* forming an outer surface of the first tower 220.

In the blower 1, the second tower 230 may include a second inner wall 231*e* facing the first tower 220 and forming an inner surface of the second tower 230, and a second outer wall 231*d* forming an outer surface of the second tower 230.

In the blower 1, the bridge 161 may connect the lower portions of the first inner wall 221*e* and the second inner wall 231*e*.

In the blower 1, the bridge 161 may be concave downward.

In the blower 1, the supporter 620 may be connected to the vicinity of a center in a front and rear direction of the bridge 161.

In the blower 1, the supporter 620 may include a first protrusion 622*a* elongated upward from an upper portion of the supporter 620, and a second protrusion 622*b* elongated upward from an upper portion of the supporter 620 and spaced apart from the first protrusion 622*a*.

In the blower 1, a portion of the bridge 161 may be inserted between the first protrusion 622*a* and the second protrusion 622*b*.

According to at least one of the embodiments of the present disclosure, the handle is provided in the lower case, so that the transport of the blower can be facilitated.

According to at least one of the embodiments of the present disclosure, the handle is provided in the lower case, so that the handle can be provided at a position that is easy for a user to grip.

According to at least one of the embodiments of the present disclosure, the handle is disposed between the fan and the air guide, so that the handle can be disposed at a position to enhance the blowing performance of the blower.

According to at least one of the embodiments of the present disclosure, the handle is provided with the guide wall inclined toward the front end of the tower, so that air blown by the fan can be guided toward the front end of the tower.

According to at least one of the embodiments of the present disclosure, since the air guide and the discharge port are disposed close to the rear end of the tower, the air guided to the front end of the tower by the handle can be evenly spread in an up-down direction.

The benefits of the present disclosure are not limited to those mentioned above, and other benefits not mentioned herein will be clearly understood by those skilled in the art from the following description.

DESCRIPTION OF EXEMPLARY EMBODIMENTS

Figure 1:
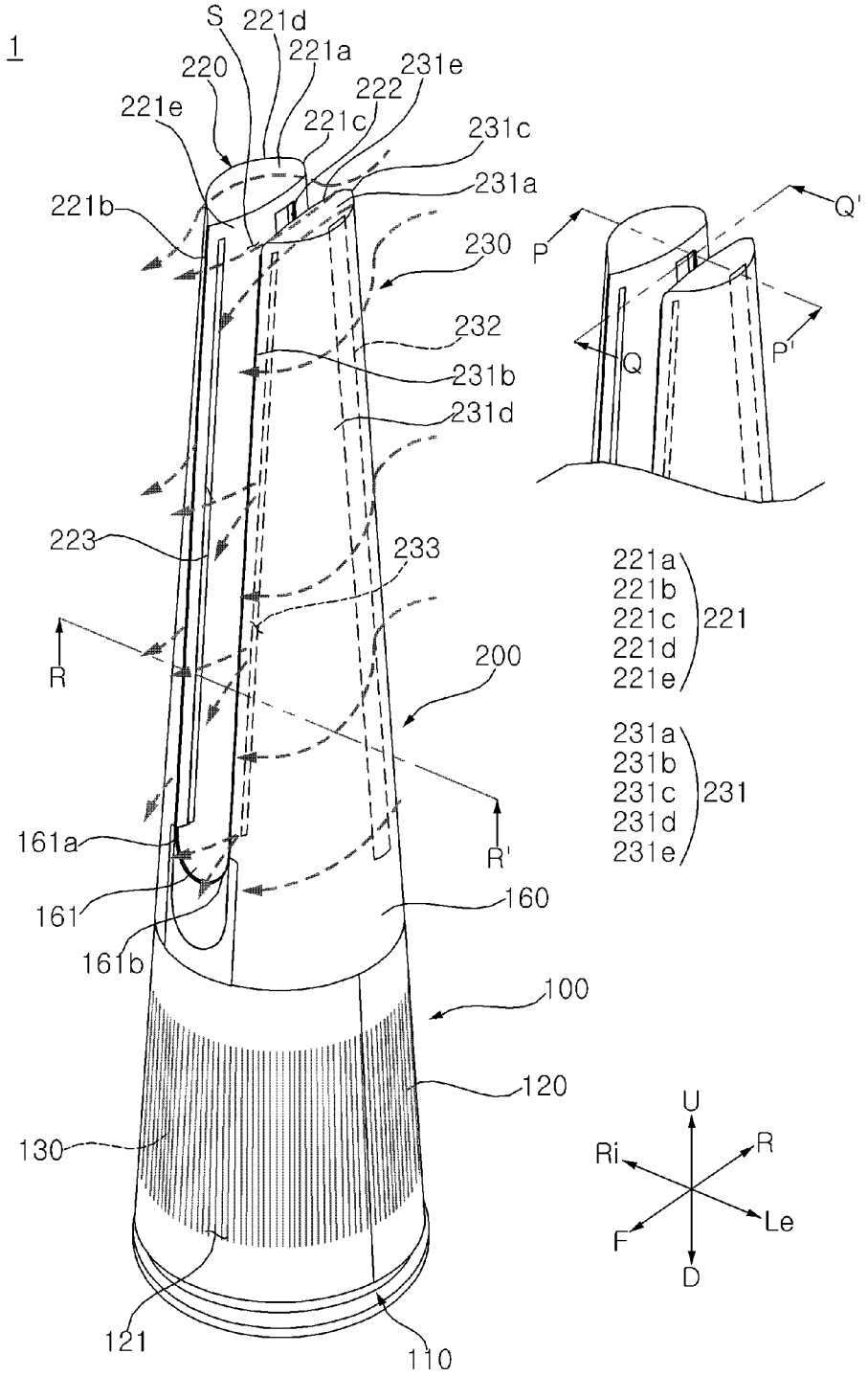
FIG. 1 is a perspective view of a blower according to an embodiment of the present disclosure.

Hereinafter, exemplary embodiments disclosed in the present specification will be described in detail with reference to the accompanying drawings, but identical or similar elements are denoted by the same reference numerals regardless of reference numerals, and redundant descriptions thereof will be omitted.

With respect to components used in the following description, the suffixes "module" and "unit" are merely given or mixed in consideration of only facilitation of description and do not have any distinct importance or role.

In describing the embodiments disclosed in the present specification, when it is determined that a detailed description of related known technologies may obscure the subject matter of the embodiments disclosed in the present specification, the detailed description thereof will be omitted. In addition, the accompanying drawings are for easy understanding of the embodiments disclosed in the present specification, and the technical idea disclosed in the present specification is not limited by the accompanying drawings, and it is to be understood as including all changes, equivalents, and substitutes included in the spirit and technical scope of the present disclosure.

Terms including ordinal numbers, such as first and second, may be used to describe various elements, but the elements are not limited by the terms. The terms are used only for the purpose of distinguishing one component from another component.

It will be understood that when a component is referred to as being "connected" or "coupled" to another component, the two components may be directly connected or coupled to each other, or intervening components may be present between the two components. It will be understood that when a component is referred to as being "directly connected or coupled," no intervening components are present between the two components.

A singular expression includes a plural expression, unless the context clearly states otherwise.

Referring to FIG. 1, the overall structure of the blower 1 will be described first. FIG. 1 shows the overall outer shape of the blower 1.

The blower 1 may be named by other names such as an air conditioner, an air clean fan, and an air purifier, in that it sucks air and circulates the sucked air.

The blower 1 according to an embodiment of the present disclosure may include a suction module 100 through which air is sucked, and a blower module 200 through which the sucked air is discharged.

The blower 1 may have a columnar shape that decreases in diameter toward an upper portion, and the blower 1 may have a conical or truncated cone shape as a whole. When the cross section becomes narrower toward am upper side, there are benefits in that the center of gravity is lowered and the overturn risk due to external impact is reduced. However, unlike the present embodiment, the cross section does not need to be in a form that becomes narrower toward the upper side.

The suction module 100 may be formed to gradually decrease in diameter toward an upper end, and the blower module 200 may also be formed to gradually decrease in diameter toward the upper end.

The suction module 100 may include a base 110, the lower case 120 disposed on an upper side of the base 110, and a filter 130 disposed in an inner side of the lower case 120.

The base 110 may be seated on the ground, and may support the load of the blower 1. The lower case 120 and the filter 130 may be seated on an upper side of the base 110.

The outer shape of the lower case 120 may be cylindrical, and may form a space in which the filter 130 is disposed therein. The lower case 120 may have a suction port 121 that is opened toward an inner side of the lower case 120 formed therein. A plurality of suction ports 121 may be formed along a circumference of the lower case 120. Each of the plurality of suction ports 121 may be elongated in an up-down direction.

The outer shape of the filter 130 may be cylindrical, and may filter out foreign substances contained in the air introduced through the suction port 121.

The blowing module 200 may be disposed separately in the form of two columns elongated up and down. The blowing module 200 may include the first tower 220 and the second tower 230 that are spaced apart from each other. The blowing module 200 may include a tower base 160 connecting the first tower 220 and the second tower 230 to the suction module 100. The tower base 160 may be disposed in an upper side of the suction module 100, and may be disposed in a lower side of the first tower 220 and the second tower 230.

The outer shape of the tower base 160 may be cylindrical, and may be disposed in an upper side of the suction module 100 to form a continuous outer circumferential surface with the suction module 100. The tower base 160 may be a portion of the lower case 120. The lower case 120 may include the tower base 160.

An upper surface of the tower base 160 may be formed to be concave downward, and may form a groove 161 elongated in a front and rear direction. The first tower 220 may be elongated to an upper side from one side 161*a* of the groove 161, and the second tower 230 may be elongated to an upper side from an other side 161*b* of the groove 161.

The tower base 160 may distribute the filtered air blown from an inside of the suction module 100, and provide the distributed air to each of the first tower 220 and the second tower 230.

The tower base 160, the first tower 220, and the second tower 230 may be manufactured as each separate parts, or may be manufactured integrally. The tower base 160 and the first tower 220 may form a continuous outer circumferential surface of the blower 1, and the tower base 160 and the second tower 230 may form a continuous outer circumferential surface of the blower 1. The tower base 160 may be a portion of the lower case 120. The first tower 220 and the second tower 230 may be referred to as an "upper case" disposed in an upper side of the lower case 120.

Unlike the present embodiment, the first tower 220 and the second tower 230 may be directly assembled to the suction module 100 without the tower base 160, and may be manufactured integrally with the suction module 100.

The first tower 220 and the second tower 230 may be disposed to be spaced apart from each other, and a blowing space S may be formed between the first tower 220 and the second tower 230.

The blowing space S may be understood as a space between the first tower 220 and the second tower 230 in which a forward, a rearward, and an upward are opened.

The outer shape of the blower module 200 composed of the first tower 220, the second tower 230, and the blowing space S may be a truncated cone.

Discharge ports 222 and 232 formed in each of the first tower 220 and the second tower 230 may discharge air toward the blowing space S. When it is necessary to distinguish the discharge ports 222 and 232, a discharge port formed in the first tower 220 is referred to as the first discharge port 222, and a discharge port formed in the second tower 230 is referred to as the second discharge port 232.

The first tower 220 and the second tower 230 may be disposed symmetrically with respect to the blowing space S. Since the first tower 220 and the second tower 230 are disposed symmetrically, the flow is uniformly distributed in the blowing space S, which is more beneficial for controlling the horizontal airflow and the rising airflow.

The first tower 220 may include a first tower case 221 that forms an outer shape of the first tower 220, and the second tower 230 may include a second tower case 231 that forms an outer shape of the second tower 230. The first tower case 221 and the second tower case 231 may be referred to as upper cases disposed in an upper side of the lower case 120 and having each of the discharge ports 222 and 232 through which air is discharged formed therein. The lower case 120 and the upper cases 221 and 231 may be included in a "case" and may be a specific concept of the case.

The first discharge port 222 may be elongated long in the first tower 220 along an up-down direction, and the second discharge port 232 may be elongated long in the second tower 230 along an up-down direction.

The flow direction of the air discharged from the first tower 220 and the second tower 230 may be formed in a front and rear direction.

The width of the blowing space S, which is an interval between the first tower 220 and the second tower 230, may be formed to be the same in an up-down direction. However, the width of an upper end of the blowing space S may be formed to be narrower or wider than the width of a lower end.

By forming the width of the blowing space S uniformly along an up-down direction, it is possible to evenly distribute the air flowing forward with respect to the blowing space S in an up-down direction.

When the width of a upper side is different from the width of a lower side, the flow velocity of the wider side may be formed low, and a deviation of the velocity may occur based on an up-down direction. When the air flow velocity deviation occurs in an up-down direction, the amount of clean air supplied may vary depending on an up-down direction position where the air is discharged.

After the air discharged from each of the first discharge port 222 and the second discharge port 232 is joined in the blowing space S, it may be supplied to a user.

The air discharged from the first discharge port 222 and the air discharged from the second discharge port 232 do not individually flow to a user, but may be supplied to the user after being joined in the blowing space S.

The blowing space S may be used as a space where the discharge air is joined and mixed. An indirect air flow is formed in the air around the blower 1 by the discharge air discharged to the blowing space S, and the air around the blower 1 may also flow toward the blowing space S.

Since the discharge air of the first discharge port 222 and the discharge air of the second discharge port 232 are joined in the blowing space S, it is possible to improve the straightness of the discharge air. By joining the discharge air of the first discharge port 222 and the discharge air of the second discharge port 232 in the blowing space S, the air around the first tower 220 and the second tower 230 may also be induced flow forward along an outer circumferential surface of the blower module 200 by an indirect airflow.

The first tower case 221 may include a first tower upper end 221*a* forming an upper side surface of the first tower 220, a first tower front end 221*b* forming a forward surface of the first tower 220, a first tower rear end 221*c* forming a rearward surface of the first tower 220, the a first outer wall 221*d* forming an outer circumferential surface of the first tower 220, and the first inner wall 221*e* forming an inner side surface of the first tower 220.

The second tower case 231 may include a second tower upper end 231*a* forming an upper side surface of the second tower 230, a second tower front end 231*b* forming a forward surface of the second tower 230, a second tower rear end 231*c* forming a rearward surface of the second tower 230, the second outer wall 231*d* forming an outer circumferential surface of the second tower 230, and the second inner wall 231*e* forming an inner side surface of the second tower 230.

The first outer wall 221*d* and the second outer wall 231*d* may be formed to be convex outward in a radial direction to form an outer circumferential surface of each of the first tower 220 and the second tower 230.

The first inner wall 221*e* and the second inner wall 231*e* are formed to be convex inwardly in a radial direction to form an inner circumferential surface of each of the first tower 220 and the second tower 230.

The first discharge port 222 may be formed to be elongated in an up-down direction with respect to the first inner wall 221*e*, and may be formed to be opened inwardly in a radial direction. The second discharge port 232 may be formed to be elongated in an up-down direction with respect to the second inner wall 231*e*, and may be formed to be opened inwardly in a radial direction.

The first discharge port 222 may be formed at a position closer to the first tower rear end 221*c* than the first tower front end 221*b*. The second discharge port 232 may be formed at a position closer to the second tower rear end 231*c* than the second tower front end 231*b*.

A first board slit 223 through which a first airflow converter 401 (see FIG. 5) to be described later penetrates may be formed to be elongated in an up-down direction with respect to the first inner wall 221*e*. A second board slit 233 through which a second airflow converter 402 (see FIG. 5)

to be described later penetrates may be formed to be elongated in an up-down direction with respect to the second inner wall 231*e*. The first board slit 223 and the second board slit 233 may be formed to be opened toward the blowing space S.

The first board slit 223 may be formed at a position closer to the first tower front end 221*b* than the first tower rear end 221*c*. The second board slit 233 may be formed at a position closer to the second tower front end 231*b* than the second tower rear end 231*c*. The first board slit 223 and the second board slit 233 may be formed to face each other.

Figure 2:
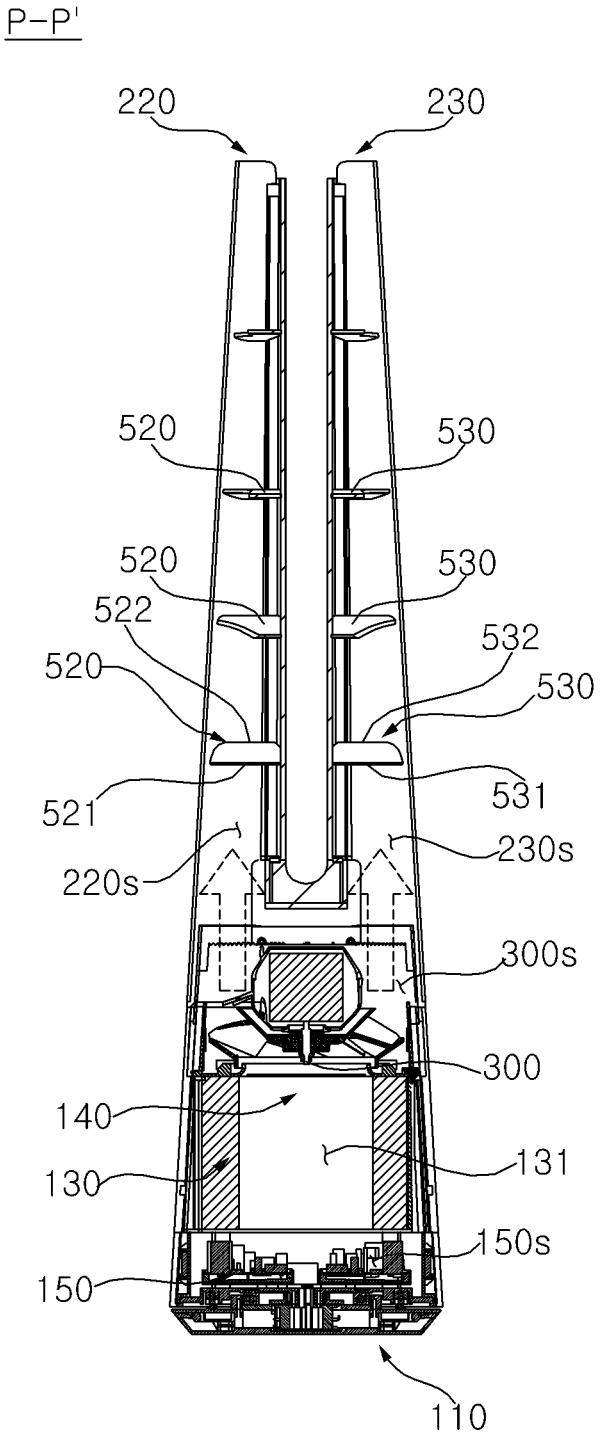
FIG. 2 is a cross-sectional view taken along line P-P' illustrated in FIG. 1.
Figure 3:
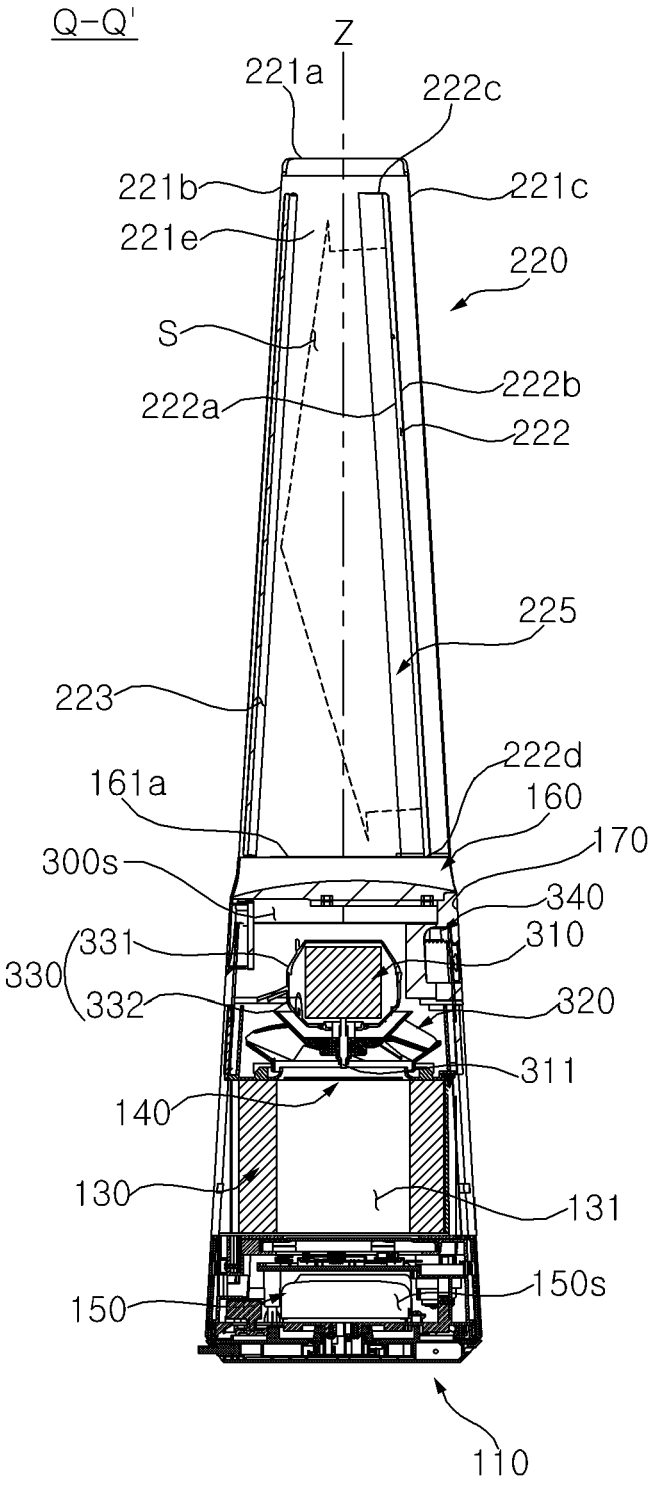
FIG. 3 is a cross-sectional view taken along line Q-Q' illustrated in FIG. 1.

Hereinafter, the internal structure of the blower 1 will be described with reference to FIGS. 2 and 3. FIG. 2 is a cross-sectional perspective view of the blower 1 cut along line P-P' illustrated in FIG. 1, and FIG. 3 is a cross-sectional perspective view of the blower 1 cut along line Q-Q' illustrated in FIG. 1.

Referring to FIG. 2, a substrate assembly 150 for controlling the operation of a fan assembly 300 may be disposed in an upper side of the base 110. A control space 150S in which the substrate assembly 150 is disposed may be formed in the upper side of the base 110.

The filter 130 may be disposed in an upper side of the control space 150S. The outer shape of the filter 130 may be a cylindrical shape, and a cylindrical filter hole 131 may be formed in an inner side of the filter 130.

Air introduced through the suction port 121 may pass through the filter 130 and flow to the filter hole 131.

A suction grill 140 through which air flowing to an upper side through the filter 130 passes may be disposed in an upper side of the filter 130. The suction grill 140 may be disposed between the fan assembly 300 and the filter 130. The suction grill 140 may prevent a hand of a user from being put into the fan assembly 300 when the lower case 120 is removed and the filter 130 is separated from the blower 1.

The fan assembly 300 may be disposed in an upper side of the filter 130, and may generate suction force for the air outside the blower 1.

By the driving of the fan assembly 300, the air outside the blower 1 passes through the suction port 121 and the filter hole 131 sequentially and blows to the first tower 220 and the second tower 230.

Between the filter 130 and the blower module 200, a pressurized space 300*s* in which the fan assembly 300 is disposed may be formed.

A first distribution space 220*s* in which the air passing through the pressurized space 300*s* flows to an upper side may be formed inside the first tower 220, and a second distribution space 230*s* in which the air passing through the pressurized space 300*s* flows to an upper side may be formed inside the second tower 230. The tower base 160 may distribute the air that has passed through the pressurized space 300*s* to the first distribution space 220*s* and the second distribution space 230*s*. The tower base 160 may be a channel connecting the first and second towers 220 and 230 and the fan assembly 300. The first distribution space 220*s* may mean an internal space of the first tower 220. The second distribution space 230*s* may mean an inner space of the second tower 230.

The first distribution space 220*s* may be formed between the first outer wall 221*d* and the first inner wall 221*e*. The second distribution space 230*s* may be formed between the second outer wall 231*d* and the second inner wall 231*e*.

The first tower 220 may include a first air guide 520 for guiding a flow direction of the air in the first distribution space 220*s*. A plurality of first air guides 520 may be disposed to be vertically spaced apart from each other.

The first air guide 520 may be elongated from the first tower rear end 221*c* toward the first tower front end 221*b*. The first air guide 520 may be spaced apart from the rear of the first tower front end 221*b*. The first air guide 520 may be elongated to be inclined to a lower side toward the front. An angle at which each of the plurality of first air guides 520 is inclined to a lower side may be smaller as disposed closer to an upper side. A detailed description thereof will be provided later.

The second tower 230 may include a second air guide 530 for guiding a flow direction of the air in the second distribution space 230*s*. A plurality of second air guides 530 may be disposed to be vertically spaced apart from each other.

The second air guide 530 may be elongated from the second tower rear end 231*c* toward the second tower front end 231*b*. The second air guide 530 may be spaced apart from the rear of the second tower front end 231*b*. The second air guide 530 may be elongated to be inclined downward toward the front. An angle at which each of the plurality of second air guides 530 is inclined downward may be smaller as disposed closer to an upper side. A detailed description thereof will be provided later.

The first air guide 520 may guide a flow direction of the air discharged from the fan assembly 300 toward the first discharge port 222. The second air guide 530 may guide a flow direction of the air discharged from the fan assembly 300 toward the second discharge port 232.

Referring to FIG. 3, the fan assembly 300 may include the fan motor 310 for generating power, the fan motor housing 330 in which the fan motor 310 is accommodated, the fan 320 rotating by receiving power from the fan motor 310, and a diffuser 340 for guiding the air pressurized by the fan 320 upward.

The fan motor 310 may be disposed in an upper side of the fan 320, and may be connected to the fan 320 through a motor shaft 311 elongated downward from the fan motor 310.

The fan motor housing 330 may include a first motor housing 331 covering an upper portion of the fan motor 310 and a second motor housing 332 covering a lower portion of the fan motor 310.

The first discharge port 222 may be elongated to an upper side from the one side 161*a* of a groove 161. A first discharge port lower end 222*d* may be formed on the one side 161*a* of the groove 161.

The first discharge port 222 may be spaced apart from a lower side of the first tower upper end 221*a*. A first discharge port upper end 222*c* may be spaced apart from a lower side of the first tower upper end 221*a*.

The first discharge port 222 may to be elongated to be inclined in an up-down direction. The first discharge port 222 may be formed to be inclined to the front toward an upper side. The first discharge port 222 may be elongated to be inclined rearward with respect to a vertical shaft Z elongated in an up-down direction.

The first discharge port front end 222*a* and the first discharge port rear end 222*b* may be elongated to be inclined in an up-down direction, and may be elongated in parallel with each other. The first discharge port front end 222*a* and the first discharge port rear end 222*b* may be elongated to be inclined rearward toward a lower side with respect to the vertical axis Z elongated in an up-down direction.

The first tower 220 may include a first discharge guide 225 for guiding the air in the first distribution space 220*s* to the first discharge port 222.

The first tower 220 may be symmetrical with the second tower 230 with respect to the blowing space S, and may have the same shape and structure as the second tower 230. The aforementioned description of the first tower 220 may be equally applied to the second tower 230.

Figure 4:
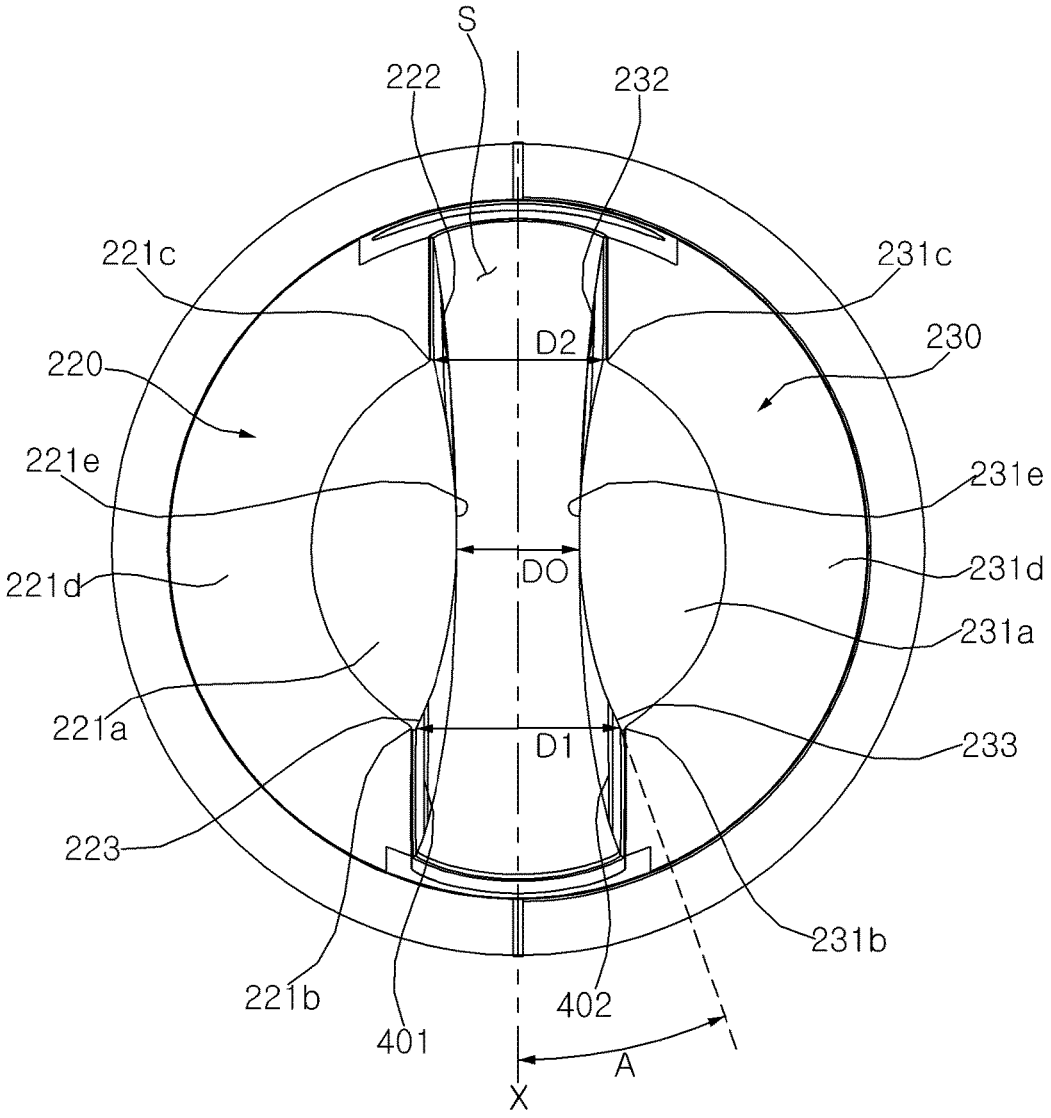
FIG. 4 is a top perspective view of the blower according to an embodiment of the present disclosure.
Figure 5:
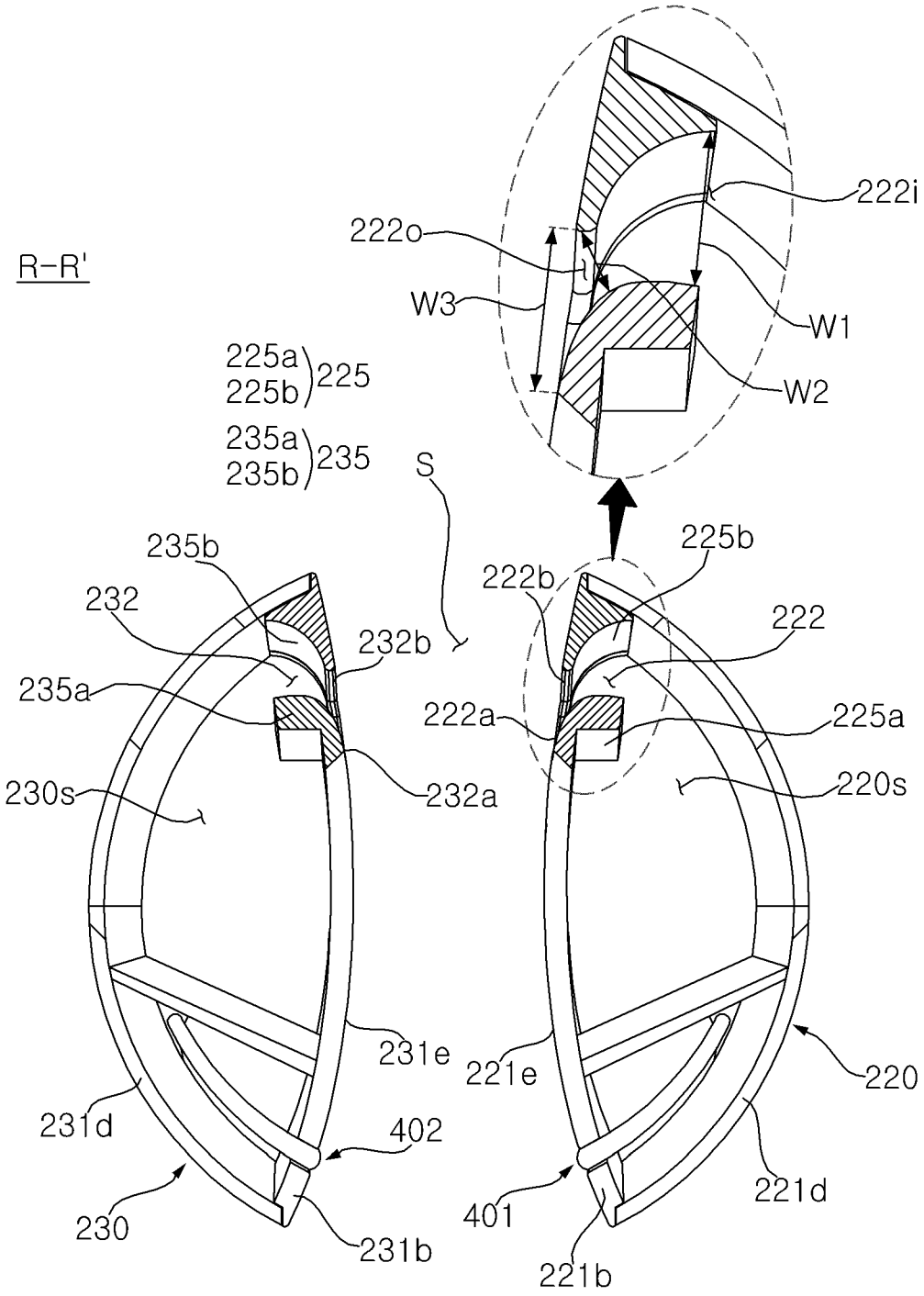
FIG. 5 is a cross-sectional view taken along line R-R' illustrated in FIG. 1.

Hereinafter, an air discharge structure of the blower 1 for inducing a Coanda effect will be described with reference to FIGS. 4 and 5. FIG. 4 illustrates a perspective view of the blower 1 from an upper side to a frontal lower part, and FIG. 5 illustrates a perspective view in which the blower 1 is cut along line R-R' illustrated in FIG. 1 and is shown from the top.

Referring to FIG. 4, gaps D0, D1, and D2 between the first inner wall 221*e* and the second inner wall 231*e* may become smaller as they get closer to the center of the blowing space S.

The first inner wall 221*e* and the second inner wall 231*e* may be formed to be convex toward the blowing space S, and the shortest distance D0 may be formed between the vertices of the first inner wall 221*e* and the second inner wall 231*e*. The shortest distance D0 may be formed in the center of the blowing space S.

The first discharge port 222 may be formed rearward than a position in which the shortest distance D0 is formed. The second discharge port 232 may be formed rearward than a position in which the shortest distance D0 is formed.

The first tower front end (221*b*) and the second tower front end (231*b*) may be spaced apart by a first gap D1. The first tower rear end 221*c* and the second tower rear end 231*c* may be spaced apart by a second interval D2.

The first interval D1 and the second interval D2 may be the same. The first interval D1 may be greater than the shortest distance D0, and the second interval D2 may be greater than the shortest distance D0.

The gap between the first inner wall 221*e* and the second inner wall 231*e* may decrease from the rear ends 221*c* and 231*c* to a position in which the shortest distance D0 is formed, and increase from a position in which the shortest distance D0 is formed to the front ends 221*b* and 231*b*.

The first tower front end (221*b*) and the second tower front end (231*b*) may be formed to be inclined with respect to a front and rear shaft X.

A tangent line drawn at each of the first tower front end 221*b* and the second tower front end 231*b* may have a predetermined inclination angle A with respect to the front and rear shaft X.

Some of the air discharged forward through the blowing space S may flow with the inclination angle A with respect to the front and rear axis X.

By the aforementioned structure, a diffusion angle of the air discharged forward through the blowing space S may be increased.

The first airflow converter 401 may be in a state drawn to the first board slit 223 when the air is discharged forward through the blowing space S.

The second airflow converter 402 may be in a state drawn to the second board slit 233 when the air is discharged forward through the blowing space S.

Referring to FIG. 5, the air discharged toward the blowing space S may be guided in a flow direction by the first discharge guide 225 and the second discharge guide 235.

The first discharge guide 225 may include a first inner guide 225*a* connected to the first inner wall 221*e* and a first outer guide 225*b* connected to the first outer wall 221*d*.

The first inner guide 225*a* may be manufactured integrally with the first inner wall 221*e*, but may be manufactured as a separate part.

The first outer guide 225*b* may be manufactured integrally with the first outer wall 221*d*, but may be manufactured as a separate part.

The first inner guide 225*a* may be formed to protrude from the first inner wall 221*e* toward the first distribution space 220*s*.

The first outer guide 225*b* may be formed to protrude from the first outer wall 221*d* toward the first distribution space 220*s*. The first outer guide 225*b* may be formed to be spaced apart from an outside of the first inner guide 225*a*, and the first discharge port 222 may be formed with the first inner guide 225*a* therebetween.

The radius of curvature of the first inner guide 225*a* may be smaller than the radius of curvature of the first outer guide 225*b*.

The air in the first distribution space 220*s* may flow between the first inner guide 225*a* and the first outer guide 225*b* and flow into the blowing space S through the first discharge port 222.

The second discharge guide 235 may include a second inner guide 235*a* connected to the second inner wall 231*e* and a second outer guide 235*b* connected to the second outer wall 231*d*.

The second inner guide 235*a* may be manufactured integrally with the second inner wall 231*e*, but may be manufactured as a separate part.

The second outer guide 235*b* may be manufactured integrally with the second outer wall 231*d*, but may be manufactured as a separate part.

The second inner guide 235*a* may be formed to protrude from the second inner wall 231*e* toward the second distribution space 230*s*.

The second outer guide 235*b* may be formed to protrude from the second outer wall 231*d* toward the second distribution space 230*s*. The second outer guide 235*b* may be formed to be spaced apart from an outside of the second inner guide 235*a*, and the second discharge port 232 may be formed with the second inner guide 235*a* therebetween.

The radius of curvature of the second inner guide 235*a* may be smaller than the radius of curvature of the second outer guide 235*b*.

The air in the second distribution space 230*s* may flow between the second inner guide 235*a* and the second outer guide 235*b* and flow into the blowing space S through the second discharge port 232.

The widths w1, w2, and w3 of the first discharge port 222 may be formed to gradually decrease from an inlet to an outlet of the first discharge guide 225 and then increase.

The size of an inlet width w1 of the first discharge guide 225 may be greater than an outlet width w3 of the first discharge guide 225.

An inlet 222*i* of the first discharge port 222 may have the inlet width w1. An outlet 222*o* of the first discharge port 222 may have an outlet width w3. The inlet 222*i* of the first discharge port 222 may be positioned at the rear of the outlet 222*o*. The air introduced into the first discharge port 222 may flow forward from the inlet 222*i* to the outlet 222*o*.

The inlet width w1*l* may be defined as a gap between an outer end of the first inner guide 225*a* and an outer end of the first outer guide 225*b*. The outlet width w3 may be defined as a gap between the first discharge port front end 222*a*, which is an inner end of the first inner guide 225*a*, and the first discharge port rear end 222*b*, which is an inner end of the first outer guide 225*b*.

The size of the inlet width w1 and the outlet width w3 may be greater than the size of the shortest width w2 of the first discharge port 222.

The shortest width w2 may be defined as the shortest distance between the first discharge port rear end 222*b* and the first inner guide 225*a*.

The width of the first discharge port 222 may gradually decrease from an inlet of the first discharge guide 225 to a position where the shortest width w2 is formed, and may gradually increase from a position where the shortest width w2 is formed to an outlet of the first discharge guide 225.

Like the first discharge guide 225, the second discharge guide 235 may have a second discharge port front end 232*a* and a second discharge port rear end 232*b* formed therein, and may have the same width distribution as the first discharge guide 225.

Figure 6:
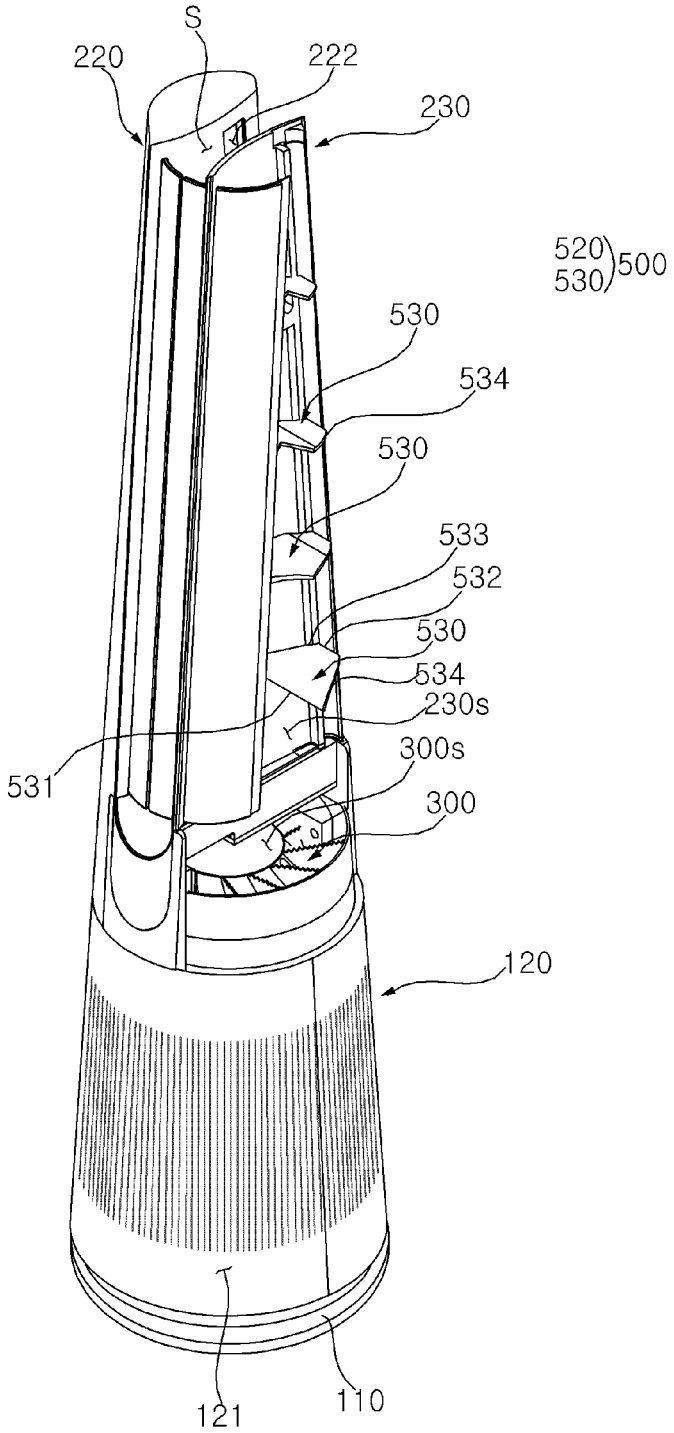
FIG. 6 is a view for explaining an internal structure of a tower according to an embodiment of the present disclosure.

Hereinafter, the disposition of an air guide 500 will be described with reference to FIG. 6. FIG. 6 illustrates an internal structure of the second tower 230 and the tower base 160 by cutting out a portion of the case in the blower 1 illustrated in FIG. 1.

The air guide 500 may include a first air guide 520 disposed in the first tower 220, and a second air guide 530 disposed in the second tower 230. The first air guide 520 and the second air guide 530 may have the same structure, and may be symmetrical to each other based on the blowing space S. The description of the second air guide 530 to be described below may be equally applied to the first air guide 520.

The fan assembly 300 may introduce outside air of the blower 1 into the lower case 120 through the suction port 121. The air introduced into the lower case 120 may flow into the pressurized space 300*s* through the filter hole 131. The lower case 120 may include a door 129, and the door 129 may be detachably attached to the lower case 120. When the door 129 is separated from the lower case 120, the filter 130 may be in a state in which it may be withdrawn from an inside of the case.

The air introduced into the pressurized space 300*s* by the fan assembly 300 may be introduced into the second tower 230 through the second distribution space 230*s*. The air introduced into the second tower 230 may flow upward, and the flow direction may be guided by the second air guide 530.

The second air guide 530 may be disposed in an upper side of the fan assembly 300, and may be disposed in the second distribution space 230*s*.

A plurality of second air guides 530 may be disposed to be paced apart in an up-down direction. The number of the second air guides 530 is not limited, but four thereof may be disposed.

The second air guide 530 may be elongated in a front and rear direction from the second tower rear end 231*c* toward the second tower front end 231*b*. A guide rear end 532 of the second air guide 530 may be connected to the second tower rear end 231*c*. A guide front end 531 of the second air guide 530 may be spaced apart from the rear of the second tower front end 231*b*.

The second air guide 530 may have a plate shape elongated in a horizontal direction, and may have a curved shape. A guide inner end 533 of the second air guide 530 may be in close contact with or connected to the second inner wall 231*e*. A guide outer end 534 of the second air guide 530 may be in close contact with or connected to the second outer wall 231*d*. The second air guide 530 may have a curved plate shape elongated between the second inner wall 231*e* and the second outer wall 231*d*.

Figure 7:
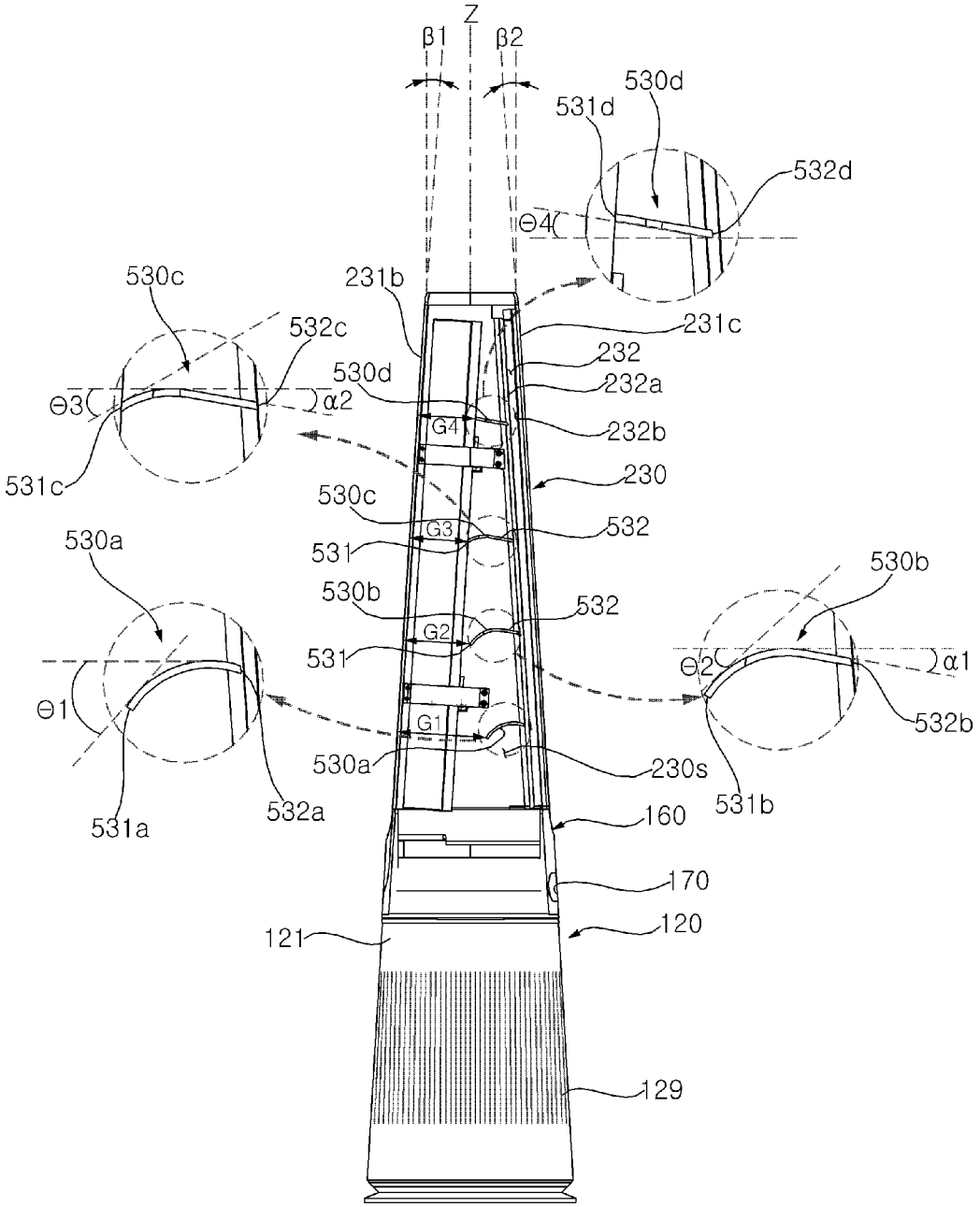
FIG. 7 is a view for explaining the internal structure of the tower according to an embodiment of the present disclosure.

Hereinafter, with reference to FIG. 7, the structure of the air guide 500 will be described in detail. FIG. 7 is a view of the blower 1 illustrated in FIG. 6 as a perspective view from the side.

Hereinafter, the air guide 500 will be described with the second air guide 530 as an example for convenience of explanation, but the description of the second air guide 530 may be applied in the same manner as the first air guide 520.

The second air guide 530 may be disposed closer to the second tower rear end 231*c* than the second tower front end 231*b*. The guide front end 531 may be spaced apart from the rear of the second tower front end 231*b*, and the guide rear end 532 may be spaced apart from the front of the second tower rear end 231*c*.

The second air guide 530 may be fixed to the second tower case 231 by coupling the guide rear end 532 to the second tower rear end 231*c*. The second air guide 530 may be fixed to the second tower case 231 by coupling the guide inner end 533 and the guide outer end 534 to the second inner wall 231*e* and the second outer wall 231*d*, respectively.

The air guide 500 may be disposed in a plural number to be spaced apart in an up-down direction. The air guides 500, 520, and 530 include a first guide 530*a*, a second guide 530*b* disposed in an upper side of the first guide 530*a*, a third guide 530*c* disposed in an upper side of the second guide 530*b*, and a fourth guide 530*d* disposed in an upper side of the third guide 530*c*.

The first guide 530*a* may refer to the air guide 500 disposed at a lowermost side among the plurality of air guides 500. A lower surface of the first guide 530*a* may face the fan assembly 300, and an upper surface of the first guide 530*a* may face a lower surface of the second guide 530*b*.

The second guide 530*b* may refer to the air guide 500 disposed adjacent to the first guide 530*a* among the plurality of air guides 500. A lower surface of the second guide 530*b* may face an upper surface of the first guide 530*a*, and an upper surface of the second guide 530*b* may face a lower surface of the third guide 530*c*.

The third guide 530*c* may refer to the air guide 500 disposed adjacent to the fourth guide 530*d* among the plurality of air guides 500. A lower surface of the third guide 530*c* may face an upper surface of the second guide 530*b*, and an upper surface of the third guide 530*c* may face a lower surface of the fourth guide 530*d*.

The fourth guide 530*d* may refer to the air guide 500 disposed at an uppermost side among the plurality of air guides 500. A lower surface of the fourth guide 530*d* may face an upper surface of the third guide 530*c*, and an upper surface of the fourth guide 530*d* may face the second tower upper end 231*a*.

The second guide 530*b* and the third guide 530*c* may refer to the air guide 500 disposed between the first guide 530*a* and the fourth guide 530*d*.

The air guide 500 may be formed to be curved. Some of the plurality of air guides 500 may be formed to be convex to an upper side. Some of the plurality of air guides 500 may be elongated to be inclined to an upper side. Some of the plurality of air guides 500 may be formed in a flat plate shape. Some of the plurality of air guides 500 may be formed to be curved toa lower side.

The first guide 530*a* may be formed to be curved to a lower side toward the front. The guide front end 531*a* of the first guide 530*a* may be positioned at a lower side than the guide rear end 532*a*. The first guide 530*a* may be elongated to be curved in a horizontal direction from the tower rear end 231*c* toward the front, and may be curved to a lower side toward the front. A tangent line at the guide front end 531*a* of the first guide 530*a* may have a downward inclination angle θ1 with respect to the horizontal direction.

The second guide 530*b* may be formed to be convex to an upper side. The second guide 530*b* may be elongated to be curved from the tower rear end 231*c* toward the front, and may have an upwardly convex shape. The guide front end 531*b* of the second guide 530*b* may be positioned at a lower side than the guide rear end 532*b*. A tangent line at the guide front end 531*b* of the second guide 530*b* may have a downward inclination angle θ2 with respect to the horizontal direction. A tangent line at the guide rear end 532*b* of the second guide 530*b* may have a downward inclination angle α1 with respect to the horizontal direction.

The third guide 530*c* may be formed to be convex to an upper side. The third guide 530*c* may be elongated to be curved from the tower rear end 231*c* toward the front, and may have an upwardly convex shape. The guide front end 531*c* of the third guide 530*c* may be positioned at an upper side than the guide rear end 532*c*. A tangent line at the guide front end 531*c* of the third guide 530*c* may have a downward inclination angle θ3 with respect to the horizontal direction. A tangent line at the guide rear end 532*c* of the third guide 530*c* may have a downward inclination angle α2 with respect to the horizontal direction.

The fourth guide 530*d* may be elongated to be inclined to an upper side. The fourth guide 530*d* may be elongated from the tower rear end 231*c* toward the front, and may have a flat plate shape. The guide front end 531*d* of the fourth guide 530*d* may be located at an upper side than the guide rear end 532*d*. The upper and lower surfaces of the fourth guide 530*d* may have an upward inclination angle θ4 with respect to the horizontal direction. The inclination angle θ4 of the fourth guide 530*d* may be constantly maintained in a front and rear direction.

A distance that each of the plurality of air guides 530*a*, 530*b*, 530*c*, and 530*d* and the tower front end 231*b* are spaced apart may be formed to be different from each other.

The first guide 530*a* may be spaced apart from the tower front end 231*b* by a first gap G1. The second guide 530*b* may be spaced apart from the tower front end 231*b* by a second gap G2. The third guide 530*c* may be spaced apart from the tower front end 231*b* by a third gap G3. The fourth guide 530*d* may be spaced apart from the tower front end 231*b* by a fourth gap G4.

As the plurality of air guides 500 are disposed in a lower side, the gaps G1, G2, G3, and G4 between the plurality of air guides 500 and the tower front end 231*b* may be widened. The first gap G1 may be wider than the second gap G2, the second gap G2 may be wider than the third gap G3, and the third gap G3 may be wider than the fourth gap G4.

The second tower front end 231*b* may be elongated to be inclined in an up-down direction. The second tower front end 231*b* may be elongated to be inclined to the rear toward an upper side. The second tower front end 231*b* may be closer to the vertical axis Z positioned at a center toward an upper side. The second tower front end 231*b* may have a rearward inclination angle β1 with respect to the up-down direction.

The second tower rear end 231*c* may be elongated to be inclined in an up-down direction. The second tower rear end 231*c* may be elongated to be inclined to the front toward an upper side. The second tower rear end 231*c* may be closer to the vertical axis Z positioned at a center toward an upper side. The second tower rear end 231*c* may have a forward inclination angle β2 with respect to the up-down direction.

The second discharge port 232 may be elongated to be inclined in an up-down direction. The second discharge port 232 may be elongated to be inclined to the front toward an upper side. The second discharge port 232 may be closer to the vertical axis Z positioned at a center toward an upper side. The second discharge port 232 may be elongated in parallel with the second tower rear end 231*c*. The second discharge port front end 232*a* and the second discharge port rear end 232*b* may be elongated in parallel.

The tower front end 231*b*, the tower rear end 231*c*, and the discharge port 232 are formed to be inclined, and the gaps G1, G2, G3, and G4 between the air guide 500 and the tower front end 231*b* become narrower toward an upper side. Accordingly, the air blown by the fan 320 may be smoothly guided to the discharge port 232 by the air guide 500. In addition, the tower front end 231*b*, the tower rear end 231*c*, and the discharge port 232 are formed to be inclined, and the gaps G1, G2, G3, and G4 between the air guide 500 and the tower front end 231*b* become narrower toward an upper side. Accordingly, the air discharged through the discharge port 232 may be uniformly distributed up and down.

In more detail, the air blown by the fan 320 has a higher pressure as it is closer to the fan 320 and a lower pressure as it moves away from the fan 320. Accordingly, by forming a wide gap between the air guide 500 positioned close to the fan 320 and the tower front end 231*b*, a higher flow rate of air is induced to be diffused upward, and simultaneously, the air discharged through the discharge port 232 is prevented from being concentrated in a lower portion. In addition, by forming a narrow gap between the tower front end 231*b* and the air guide 500 positioned far away from the fan 320, the air whose flow rate has been reduced in the process of flowing upward is not detached and is induced to be guided to the discharge port 232 by the air guide 500.

Figure 8:
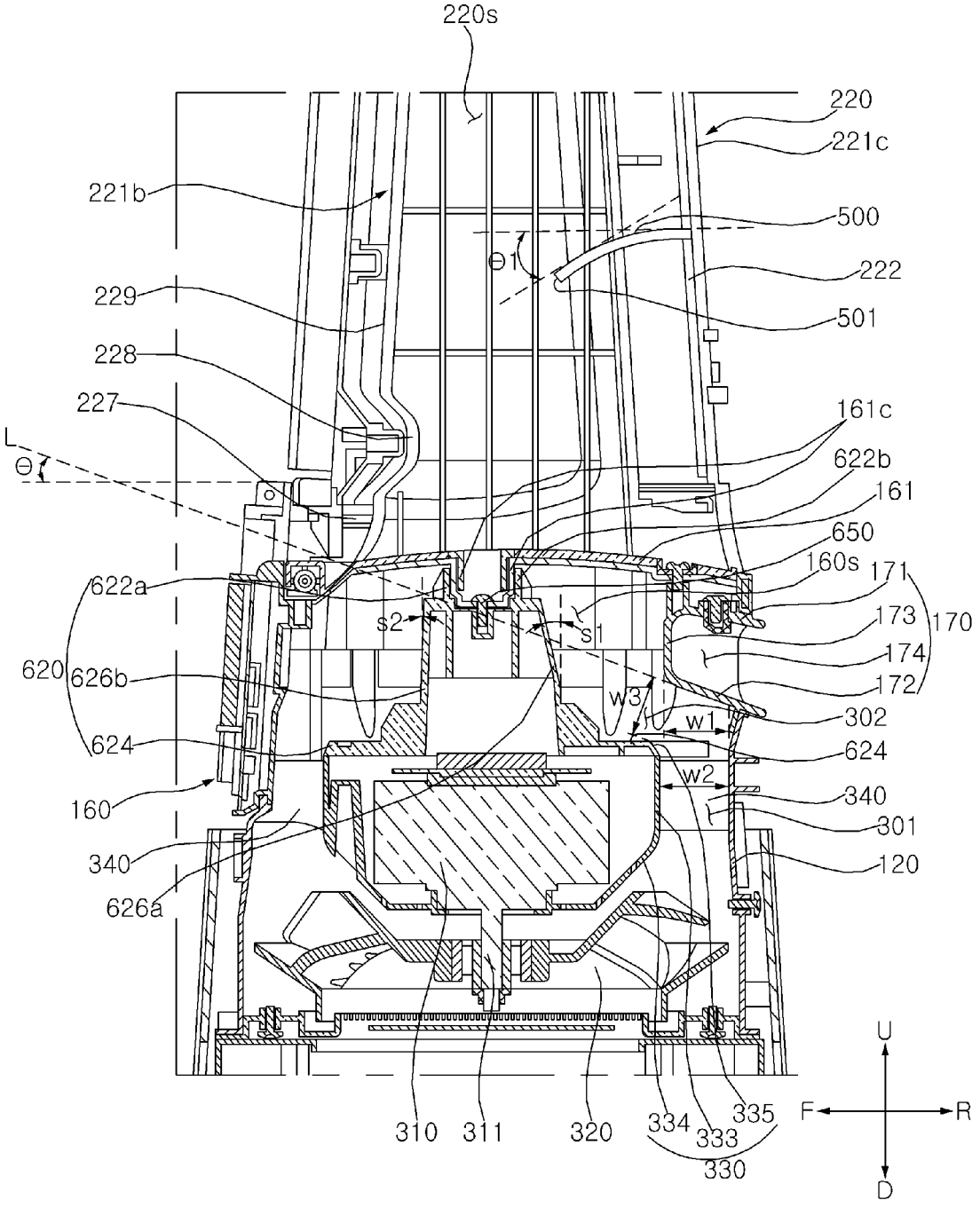
FIG. 8 is an enlarged view of a portion of the internal structure of the blower according to an embodiment of the present disclosure.

Hereinafter, the handle 170 will be described with reference to FIG. 8. FIG. 8 is an enlarged view of a portion of a longitudinal cross-sectional view of the blower 1.

The blower 1 may include the handle 170 disposed between the fan 320 and the air guide 500. The handle 170 may be elongated toward the first tower front end 221*b* from upstream of the air guide 500.

The handle 170 may protrude toward an inner space of the lower case 120. The handle 170 may protrude toward an inner space of the tower base 160. A cut portion may be formed on an outer circumferential wall of the tower base 160, and the handle 170 may be inserted into the cut portion of the tower base 160.

The handle 170 may be disposed on a rear portion of the lower case 120. The handle 170 may be disposed closer to the tower rear end 221*c* than the tower front end 221*b*. When the blower 1 is viewed from the front, the handle 170 may be hidden from a front portion of the lower case 120.

The handle 170 may be disposed between the groove 161 and the fan 320. The handle 170 may be disposed in an inner space of the tower base 160, and may be disposed in a lower side of the groove 161.

The handle 170 may include a first wall 171 elongated forward toward the inside of the lower case 120, a guide wall 172 spaced apart from a lower side of the first wall 171, and a second wall 173 connecting the first wall 171 and the guide wall 172.

The first wall 171 may penetrate through the lower case 120 and may be elongated forward. The first wall 171 may be elongated in a horizontal direction.

The guide wall 172 may be elongated to be inclined upward toward the front end 221*b* of the first tower 220. The guide wall 172 may have an inclination angle θ with respect to the horizontal direction. The guide wall 172 may be disposed in an upper side of the fan 320, and may face the fan 320 in an up-down direction.

The second wall 173 may be elongated to an upper side from the guide wall 172 to be connected to the first wall 171. The second wall 173 may be elongated in a vertical direction.

The handle 170 may include the gripping space 174 recessed toward a radially inner side of the lower case 120. The gripping space 174 may be formed between the first wall 171 and the guide wall 172. The second wall 173 may shield the front of the gripping space 174.

A channel 301 through which air blown from the fan 320 flows may be formed between the fan motor housing 330 and the lower case 120. The channel 301 may provide a passage through which the air blown from the fan 320 flows upward.

The fan motor housing 330 may include a first housing wall 333 elongated in an up-down direction, and a second housing wall 334 connected to the first housing wall 333 from an upper side of the fan 320 and elongated to be inclined toward the handle 170.

The first housing wall 333 may be disposed to surround the fan motor 310. The first housing wall 333 may be spaced apart from the lower case 120.

The second housing wall 334 may be elongated to be inclined downward from the first housing wall 333. The second housing wall 334 may be inclined toward a radially inner side of the lower case 120 toward a lower side.

The channel 301 may be formed between the fan motor housing 330 and the lower case 120. The channel 301 may be formed in a space between the first housing wall 333 and the lower case 120 and between the second housing wall 334 and the lower case 120.

Between the second housing wall 334 and the lower case 120, the channel 301 may become narrower in width in a horizontal direction toward an upper side. Accordingly, the air blown from the fan 320 may be accelerated while passing through the channel 301.

A diffuser 340 may be disposed between the first housing wall 333 and the lower case 120. The diffuser 340 may be elongated in an up-down direction. The diffuser 340 may guide the flow direction of the air introduced into the channel 301 upward.

The handle 170 may be disposed in an upper side of the channel 301. The handle 170 may face the channel 301 up and down. The handle 170 may be disposed in an upper side of the diffuser 340.

The air blown from the fan 320 may pass through the channel 301 to reach the guide wall 172 of the handle 170. The air reaching the guide wall 172 may flow toward the front end 221*b* of the first tower 220 along the inclined surface of the guide wall 172.

The width w1 of the handle 170 protruding into the inner space of the lower case 120 may be smaller than the width w2 of the channel 301. Accordingly, some of the air passing through the channel 301 may flow upward without reaching the guide wall 172.

An acceleration channel 302 may be formed between the handle 170 and the fan motor housing 330. The acceleration channel 302 may communicate with the channel 301. The acceleration channel 302 may refer to a space elongated from an upper side of the channel 301 toward the front end 221*b* of the first tower 220.

The fan motor housing 330 may include an edge 335 facing the guide wall 172. The edge 335 may be formed in an upper portion of the fan motor housing 330. The edge 335 may refer to an upper end of the first housing wall 333.

The acceleration channel 302 may be formed between the edge 335 and the guide wall 172. The width w3 of the acceleration channel 302 may be smaller than the width w2 of the channel 301.

The flow rate of the air passing through the channel 301 may increase while passing through the acceleration channel 302. The air passing through the channel 301 may be guided in the flow direction by the guide wall 172, and simultaneously, the flow rate may increase while passing through the acceleration channel 302. The air flowing toward the first tower front end 221*b* along the guide wall 172 may be diffused forward by increasing the flow rate in the acceleration channel 302.

The first tower 220 may include a protrusion 228 protruding toward the first discharge port 222 from the first tower front end 221*b*. The protrusion 228 may be positioned between the air guide 500 and the handle 170. The protrusion 228 may be integral with the first tower front end 221*b*.

The protrusion 228 may be positioned at an upper side than the groove 161. The protrusion 228 may be positioned at an upper side than an extension line L of the guide wall 172.

The first tower 220 may include a lower guide 227 that is elongated to a lower side from the protrusion 228 and an upper guide 229 that is elongated to an upper side from the protrusion 228.

The air flowing toward the first tower front end 221*b* along the guide wall 172 may reach the lower guide 227. The air reaching the lower guide 227 may be guided rearward by the protrusion 228 to reach the air guide 500. The air that has reached the air guide 500 may flow backward along the air guide 500 and be discharged into the blowing space S through the first discharge port 222. However, the flow path of the air blown from the fan 320 is not limited as described above. For example, the air blown from the fan 320 may be directly discharged through the first discharge port 222, may flow upward along the first distribution space 220*s*, may be guided forward by the guide wall 172 to reach the projection 228, or may be guided forward by the guide wall 172 to reach the upper guide 229.

The air guide 500 may be inclined downward toward the front. The air guide 500 may be inclined toward the protrusion 228 toward the front. The air guided backward by the protrusion 228 may reach the guide front end 501 of the air guide 500. The guide front end 501 may be positioned forward than the first discharge port 222. The air that has reached the guide front end 501 may flow backward along the air guide 500 and be discharged through the first discharge port 222.

Figure 9:
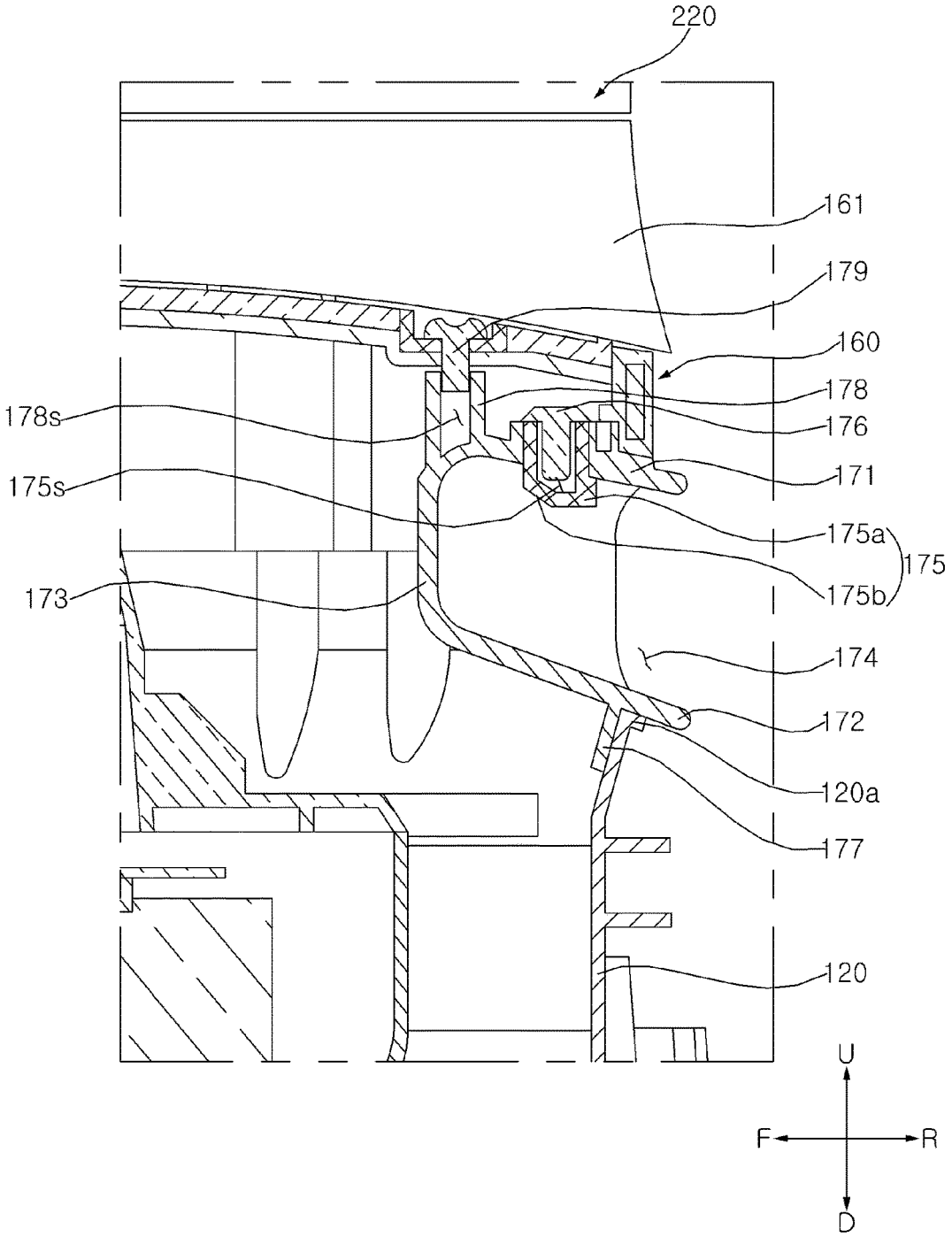
FIG. 9 is a view for explaining a handle according to an embodiment of the present disclosure.

Hereinafter, a detailed structure of the handle 170 will be described with reference to FIG. 9. FIG. 9 is an enlarged view of the handle 170 on the longitudinal cross-sectional view of the blower 1.

A gripping space 174 may be formed in a rear portion of the lower case 120. The gripping space 174 may refer to an inner space of the handle 170. A user may carry the blower 1 by putting his or her hand in the gripping space 174.

The handle 170 may include a gripping portion 175 protruding downward from the first wall 171. The gripping portion 175 may protrude toward a lower side than a lower surface of the first wall 171.

The gripping portion 175 may include a first gripping portion 175*a* protruding downward from the first wall 171 and a second gripping portion 175*b* elongated to be inclined upward from the first gripping portion 175*a* toward the front.

A user may put his or her hand in the gripping space 174 and mount his or her fingers on the gripping portion 175. The user may mount his or her fingers on the inclined surface of the second gripping portion 175*b*.

A first fastening hole 175*s* opened in an up-down direction may be formed in the gripping portion 175. The gripping portion 175 may be fixed to the handle 170 by a first fastening member 176 penetrating through the first fastening hole 175*s*.

The handle 170 may include a mounting portion 177 protruding downward from the guide wall 172. The mounting portion 177 may be positioned at an inner side of the lower case 120.

The lower case 120 may include an end portion 120*a* disposed adjacent to the handle 170. The end portion 120*a* may be elongated to be curved toward an outside of the lower case 120 toward an upper side.

The mounting portion 177 may be disposed in an inner side of the end portion 120*a*. The mounting portion 177 may be connected to the lower case 120 and may be connected to the end portion 120*a*. The mounting portion 177 may be coupled to the lower case 120 through a separate fastening member (not shown).

Since the mounting portion 177 is connected to the lower case 120 from an inner side of the lower case 120, it is possible to prevent the phenomenon that the handle 170 is separated from the lower case 120.

The handle 170 may include a boss 178 protruding toward the groove 161. The boss 178 may protrude toward an upper side from the first wall 171.

The boss 178 may include a second fastening hole 178*s* opened in an up-down direction. The handle 170 may be coupled to the groove 161 by a second fastening member 179 inserted into the second fastening hole 178*s*.

As described above, the tower base 160 may be disposed in a lower side of the first tower 220 and the second tower 230 to connect the first tower 220 and the second tower 230, and may be disposed in an upper side of the lower case 120. The inner space of the tower base 160 may be referred to as a distribution channel 160*s*. The distribution channel 160*s* may distribute the air that has passed through the pressurizing space 300*s* to the first distribution space 220*s* and the second distribution space 230*s*. The distribution channel 160*s* may have one end communicating with the pressurizing space 300*s*, and the other end communicating with the first distribution space 220*s* and the second distribution space 230*s*.

The aforementioned groove may be referred to as the bridge 161 in the sense of connecting the first tower 220 and the second tower 230 spaced apart with the blowing space S interposed therebetween. As described above, the first inner wall 221*e* of the first tower 220 may be elongated upward from one side 161*a* of the bridge 161, and the second inner wall 231*e* of the second tower 230 may be elongated upward from the other side 161*b* of the bridge 161. The bridge 161 may connect the lower portions of the first inner wall 221*e* and the second inner wall 231*e*. The bridge 161 may connect the lower portions of the surfaces 221*e* and 231*e* in which the first tower 220 and the second tower 230 face each other among the outer surfaces of the first tower 220 and the second tower 230. The bridge 161 may connect the lower portions of the first inner wall 221*e* of the first tower 220 and the second inner wall 231*e* of the second tower 230 (see FIG. 1).

As described above the bridge 161 may have a concave shape downward. Accordingly, the air flowing through the distribution channel 160*s* may flow smoothly into the first distribution space 220*s* and the second distribution space 230*s* along a concave surface of the bridge 161.

As described above, the blower 1 may have a conical or truncated cone shape as a whole (see FIG. 1). Accordingly, the first tower 220, the second tower 230, and the blowing space S that form a continuous surface with the lower case 120 may have a conical or truncated cone shape as a whole. In other words, the continuous surface formed by the first tower 220, the second tower 230, and the blowing space S with the lower case 120 may have a narrower cross-sectional area toward an upper side.

The gaps D0, D1, and D2 between the first inner wall 221*e* and the second inner wall 231*e* may become smaller as they get closer to the center of the blowing space S (see FIG. 4). The tower front ends 221*b* and 231*b*, the tower rear ends 221*c* and 231*c*, and the discharge ports 222 and 232 may be formed to be inclined toward the center on a planar cross-section. The load of the first tower 220 and the second tower 230 may be concentrated on a central portion of the tower base 160 on a planar cross-section.

Since the first tower 220 and the second tower 230 are spaced apart with the blowing space S interposed therebetween, the load of the first tower 220 and the second tower 230 may be concentrated on the lower portions of the first inner wall 221*e* and the second inner wall 231*e*.

Since the first discharge port 222 and the second discharge port 232 may be elongated long in an up-down direction, and the first tower 220 and the second tower 230 may be elongated long in an up-down direction, the blower 1 may be vulnerable to an external force that widens or narrows the first tower 220 and the second tower 230.

In this need, the support 620 may be provided for transferring the load of an upper portion of the blower 1 (in particular, the load concentrated on the inner walls 221*e* and 231*e* of the first tower 220 and the second tower 230) to a lower portion of the blower 1. Hereinafter, the supporter 620 will be described with reference in particular to FIG. 8 among FIGS. 1, 8, and 9.

The supporter 620 may be disposed inside the tower base 160. The supporter 620 may be disposed inwardly spaced apart from the tower base 160. The supporter 620 may be disposed in the vicinity of the center on a planar cross-section inside the tower base 160. The supporter 620 may be disposed in a lower side of the first tower 220 and the second tower 230. The supporter 620 may be disposed in an upper side of the motor housing 330.

The supporter 620 may connect the bridge 161 and the motor housing 330. The supporter 620 may connect the motor housing 330 to the lower portions of the surfaces of the tower 230 facing each other (that is, the first inner wall 221*e* and the second inner wall 231*e*). The supporter 620 may transfer the loads of the first tower 220 and the second tower 230 to the motor housing 330. The motor housing 330 may transfer the received load to the lower case 120 through the aforementioned diffuser 340.

The supporter 620 may be connected to the vicinity of a center in a front and rear direction of the bridge 161. Accordingly, due to the shape of the blower 1 described above, it is possible to stably support the load concentrated on the central portion on a planar flat cross-section.

The supporter 620 may include the first protrusion 622*a* elongated upward from an upper portion of the supporter 620, and the second protrusion 622*b* elongated upward from an upper portion of the supporter 620 and spaced apart from the first protrusion 622*a*. The first protrusion 622*a* and the second protrusion 622*b* may face each other. The first protrusion 622*a* and the second protrusion 622*b* may have a symmetrical shape. The first protrusion 622*a* and the second protrusion 622*b* may be integrally formed with the supporter 620.

A portion of the bridge 161 may be inserted between the first protrusion 622*a* and the second protrusion 622*b*. The bridge 161 may be inserted between the first protrusion 622*a* and the second protrusion 622*b* to be fastened to the supporter 620. The bridge 161 may include an insertion portion 161*c* inserted between the first protrusion 622*a* and the second protrusion 622*b*. The insertion portion 161*c* of the bridge 161 may have a shape protruding downward from the bridge 161. The insertion portion 161*c* of the bridge 161 may be integrally formed with the bridge 161. The insertion portion 161*c* may have a shape corresponding to the space between the first protrusion 622*a* and the second protrusion 622*b*. The lower surface of the insertion portion 161*c* may be fixed to an upper surface of the supporter 620 by a separate fastening member 650. The fastening member 650 may be, for example, a bolt penetrating a lower surface of the insertion portion 161*c* and an upper surface of the supporter 620.

The supporter 620 may have a columnar shape as a whole. The supporter 620 may include the elongation 624 elongated laterally from a lower portion of the supporter 620. The elongation 624 may be connected to an upper portion of the motor housing 330. The elongation 624 may have a cross-sectional area corresponding to a cross-sectional area of an upper portion of the motor housing 330. In this connection, the upper portion of the motor housing 330 may be understood as the elongation 624 of the supporter 620. The edge 335 of the motor housing 330 may be understood as an outer end of the elongation 624. The elongation 624 having a wider cross-sectional area is provided at a lower portion of the supporter 620 to stably transfer a load transferred from an upper portion to the motor housing 330.

The supporter 620 may have a narrower cross-sectional area toward an upper side. Accordingly, it is possible to reduce the flow resistance by minimizing the area in the distribution channel 160*s* occupied by the supporter 620 while stably transferring the load transferred from an upper portion to the motor housing 330.

The aforementioned fan motor housing 330 may be briefly referred to as the motor housing 330. As described above, the motor housing 330 may be disposed inwardly spaced apart from the lower case 120 to form the channel 301 therebetween. As described above, the motor housing 330 may be disposed to surround the fan motor 310. As described above, the diffuser 340 may be disposed between the motor housing 330 and the lower case 120. The diffuser 340 may connect a circumference of the motor housing 330 and the lower case 120. Accordingly, the load transferred from the supporter 620 to the motor housing 330 may be transferred to the lower case 120 by the diffuser 340.

As described above, the handle 170 may protrude toward an inner space of the tower base 160. Since the tower base 160 may be manufactured integrally with the lower case 120, the description of the lower case 120 related to the handle 170 may be understood as relating to the tower base 160.

The handle 170 may be disposed at a portion having a height corresponding to the supporter 620 in the tower base 160. The supporter 620 may include the first surface 626*a* facing one surface (in other words, the second wall 173) of the handle 170 protruding into an inner space, and the second surface 626*a* disposed in an opposite side of the first surface 626*a*. For example, the first surface 626*a* may be a rear surface of the supporter 620, and the second surface 626*b* may be a front surface of the supporter 620. The first surface 626*a* may face the front surface of the tower base 160, and the second surface 626*b* may face the rear surface of the tower base 160 and the handle 170.

The first surface 626*a* may be inclined at a predetermined first angle s1 toward the second surface 626*b*. The first angle may be a degree to which the first surface 626*a* is inclined toward the second surface 626*b* with respect to a virtual up-down direction vertical line. The second surface 626*b* of the supporter 620 may be inclined at a predetermined second angle s2 toward the first surface 626*a*. The second angle may be a degree to which the second surface 626*b* is inclined toward the first surface 626*a* with respect to a virtual up-down direction vertical line. The first angle s1 may be greater than the second angle s2.

As the handle 170 protrudes into an inner space of the tower base 160, the flow resistance of the air flowing through the distribution channel 160*s* may increase. Accordingly, the first surface 626*a* of the supporter 620, which is the surface facing the handle 170, is formed to be inclined to correspond to the direction in which the handle 170 protrudes as described above, so that it is possible to prevent an increase in flow resistance by the handle 170 in the distribution channel 160*s*.

The blower 1 may include: the lower case 120 formed with the suction port 121; the fan 320 disposed inside the lower case 120; the fan motor 310 disposed in an upper side of the fan 320; the motor housing 330 that is spaced apart from an inner side of the lower case 120 and surrounds the fan motor 310; the diffuser 600 connecting a circumference of the motor housing 330 and the lower case 120; the first tower 220 disposed in an upper side of the lower case 120, elongated long upward, and formed with the first discharge port 222; the second tower 230 disposed in an upper side of the lower case 120, spaced apart from the first tower 220, elongated long upward, and formed with the second discharge port 232; and the supporter 620 connecting a lower portion of surfaces 221*e* and 231*e* in which the first tower 220 and the second tower 230 face each other among the outer surfaces of the first tower 220 and the second tower 230 and the motor housing 330.

The blower 1 may further include the bridge 161 connecting lower portions of the surfaces 221*e* and 231*e* in which the first tower 220 and the second tower 230 face each other among the outer surfaces of the first tower 220 and the second tower 230. The supporter 620 may connect the bridge 161 and the motor housing 330.

In the blower 1, the supporter 620 may include the elongation 624 elongated laterally from a lower portion of the supporter 620. The elongation 624 may be connected to an upper portion of the motor housing 330.

In the blower 1, the cross-sectional area of the elongation 624 may correspond to the cross-sectional area of the upper portion of the motor housing 330.

In the blower 1, the supporter 620 may have a narrower cross-sectional area toward an upper side.

The blower 1 may further include the handle 170 disposed in a portion having a height corresponding to the supporter 620 in the lower case 120, wherein one surface protrudes inward and the other surface is opened to an outer side to form the gripping space 174. The supporter 620 may include the first surface 626*a* facing the handle 170, and the second surface 626*b* disposed in an opposite side of the first surface 626*a*. The first surface 6226*a* may be inclined at a predetermined first angle s1 toward the second surface 626*b*.

In the blower 1, the second surface 626*b* of the supporter 620 may be inclined at a predetermined second angle s2 toward the first surface 626*a*, and the first angle s1 may be greater than the second angle s2.

The blower 1 may further include the blowing space S opened back and forth between the first tower 220 and the second tower 230. The first tower 220, the second tower 230, and the blowing space S may form a continuous surface with the lower case 120.

In the blower 1, the continuous surface may be a truncated cone whose cross-sectional area becomes narrower toward an upper side.

In the blower 1, the first tower 220 may include the first inner wall 221*e* facing the second tower 230 and forming an inner surface of the first tower 220, and the first outer wall 221*d* forming an outer surface of the first tower 220. The second tower 230 may include the second inner wall 231*e* facing the first tower 220 and forming an inner surface of the second tower 230, and a second outer wall 231*d* forming an outer surface of the second tower 230. The bridge 161 may connect the lower portions of the first inner wall 221*e* and the second inner wall 231*e*.

In the blower 1, the bridge 161 may be concave downward.

In the blower 1, the supporter 620 may be connected to the vicinity of a center in a front and rear direction of the bridge 161.

In the blower 1, the supporter 620 may include the first protrusion 622*a* elongated upward from an upper portion of the supporter 620, and the second protrusion 622*b* elongated upward from an upper portion of the supporter 620 and spaced apart from the first protrusion 622*a*. A portion of the bridge 161 may be inserted between the first protrusion 622*a* and the second protrusion 622*b*.

Hereinbefore, although the preferred embodiments of the present disclosure have been disclosed for illustrative purposes, the present disclosure is not limited to the specific embodiments and various modifications may be made by those skilled in the technical field to which the present disclosure pertains without departing from the gist of the present disclosure claimed in the claims, and such modifications should not be individually understood from technical concepts or prospects of the present disclosure.

The present disclosure is able to be modified and implemented in various forms, so that the scope thereof is not limited to the above-described implementations. Therefore, when the modified implementation includes the components of the claims of the present disclosure, it should be viewed as belonging to the scope of the present disclosure.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

DESCRIPTION OF REFERENCE NUMERALS

1: BLOWER
110: BASE
120: LOWER CASE
160: TOWER BASE
170: HANDLE
220: FIRST TOWER
230: SECOND TOWER
320: FAN
330: FAN MOTOR HOUSING
340: DIFFUSER
500: AIR GUIDE

What is claimed is:

1. A blower including:

a lower case in which a suction port is formed;

a fan disposed inside the lower case;

a first tower disposed above the lower case and formed with a first discharge port;

a second tower spaced apart from the first tower in a horizontal direction, disposed above the lower case, and formed with a second discharge port;

a blowing space formed between the first and second towers, and in which air discharged from the first and second discharge ports flows;

a tower base disposed between the first and second towers and the lower case, wherein air blown from the lower case is distributed to the first and second towers;

a fan motor connected to the fan;

a fan motor housing that is disposed above the fan, surrounds the fan motor and is spaced apart from an inner circumferential surface of the lower case, wherein a channel through which air blown from the fan flows is formed between the fan motor housing and the lower case; and a handle that protrudes inside from the tower base, disposed in an upper side of the channel, and disposed to correspond to the blowing space in an up-down direction.

2. The blower of claim 1, wherein:

a plurality of suction portion is formed to be spaced apart from each other along a circumference of the lower case; and the handle is positioned at an upper side of the suction port, and penetrates through the lower case and protrudes toward an inner space of the lower case.

3. The blower of claim 1, wherein:

the tower base includes a groove connecting a lower portion of the first tower and a lower portion of the second tower, the groove being formed to be concave downward from an upper side of the fan; and the handle is disposed between the fan and the groove.

4. The blower of claim 1, wherein the handle includes a guide wall facing the fan in an up-down direction and elongated to be inclined upward toward the front end of the first and second towers.

5. The blower of claim 4, wherein the handle includes:

a first wall spaced apart from an upper side of the guide wall and elongated toward an outer side of the lower case; and a second wall connecting the first wall and the guide wall and elongated from the guide wall to an upper side thereof.

6. The blower of claim 1, wherein a width in which the handle protrudes inwardly of the tower base is smaller than a horizontal width of the channel.

7. The blower of claim 1, wherein the fan housing includes:

a first housing wall elongated in the up-down direction; and a second housing wall connected to the first housing wall in an upper side of the fan and elongated to be inclined toward the handle.

8. The blower of claim 1, further including a diffuser disposed in an upper side of the fan and elongated to an upper side toward an inner space of the first and second towers, wherein the handle is disposed in an upper side of the diffuser.

9. The blower of claim 1, further including an air guide disposed inside the first and second towers and spaced apart from a front end of the first and second towers and elongated along a front-rear direction toward the first and second discharge ports, wherein each of the first and second towers includes a protrusion protruding toward the first and second discharge ports from the front end of the first and second towers, and being positioned between the air guide and the handle.

10. The blower of claim 9, wherein:

the tower base includes a groove disposed in an upper side of the handle and connecting a lower portion of the first tower and a lower portion of the second tower; and the protrusion is positioned at an upper side of the groove.

11. The blower of claim 9, wherein:

the handle includes a guide wall facing the fan in the up-down direction and elongated to be inclined toward the front end of the first and second towers; and the protrusion is positioned at an upper side of an extension line of the guide wall.

12. The blower of claim 1, further including an air guide disposed inside the first and second towers and spaced apart from a front end of the first and second towers and elongated along a front-rear direction toward the first and second discharge ports, and wherein:

the first and second discharge ports are elongated in the up-down direction; and a plurality of the air guides are disposed to be spaced apart from each other along a direction in which the first and second discharge ports are elongated.

13. The blower of claim 12, wherein:

the air guide is elongated from a rear end of the first and second towers toward the front end of the first and second towers; and one end of the air guide is positioned forward than the first and second discharge ports.

14. The blower of claim 12, wherein:

the air guide is elongated to be inclined to a lower side toward the front; and an angle at which each of the plurality of air guides is inclined to a lower side is greater as disposed closer to the lower side.

15. The blower of claim 1, wherein the handle includes a gripping portion protruding from an upper wall of the handle toward a lower side.

16. The blower of claim 1, wherein:

the handle includes a guide wall facing the fan in the up-down direction; and a mounting portion protruding from the guide wall toward a lower side, and connected to the lower case.

17. The blower of claim 1, wherein:

the tower base includes a groove connecting a lower portion of the first tower and a lower portion of the second tower, and disposed in an upper side of the handle; and the handle includes a boss having a fastening hole elongated in the up-down direction formed therein, and protruding toward the groove.

18. The blower of claim 1, wherein the front end of the first and second towers are inclined rearward toward an upper side.

* * * * *